US008083549B1

(12) United States Patent
Chiang

(10) Patent No.: US 8,083,549 B1
(45) Date of Patent: Dec. 27, 2011

(54) ELECTRICAL CONNECTOR AND MOLDING METHOD THEREOF

(75) Inventor: Shu-Man Chiang, Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 12/887,501

(22) Filed: Sep. 21, 2010

(51) Int. Cl.
*H01R 13/648* (2006.01)

(52) U.S. Cl. ..... 439/607.55

(58) Field of Classification Search ..... 439/607.29, 439/607.35–607.4, 607.55; 29/883
See application file for complete search history.

(56) References Cited

U.S. PATENT DOCUMENTS 6,086,420 A * 7/2000 Wu ..... 439/607.4
6,315,608 B1 * 11/2001 Lopata et al. ..... 439/607.36
7,179,126 B2 * 2/2007 Chen ..... 439/607.35
7,465,194 B1 * 12/2008 Ho et al. ..... 439/607.01
2008/0050950 A1 * 2/2008 Wu ..... 439/108

* cited by examiner

*Primary Examiner* — Renee S Luebke
*Assistant Examiner* — Larisa Tsukerman

(57) ABSTRACT

An electrical connector includes an insulating housing, a plurality of terminals and a shielding shell which are molded integrally. The insulating housing has a top wall, two side walls, a bottom wall and a rear wall which are interconnected to form a box shape with an accommodating chamber formed thereamong. The terminals are molded in the insulating housing with contact portions extended into the accommodating chamber. The shielding shell includes an inner shell and an outer shell fixedly attached on the inner shell. The inner shell includes a top plate, two side plates and a bottom plate which are interconnected together to surround a receiving space thereamong. The shielding shell is molded in a periphery of the accommodating chamber with a portion of the outer shell exposed outside the insulating housing.

8 Claims, 3 Drawing Sheets

ELECTRICAL CONNECTOR AND MOLDING METHOD THEREOF

BACKGROUND OF THE INVENTION

1. Field of the Invention

The present invention generally relates to an electrical connector, and more particularly to an electrical connector having an insulating housing and a shielding shell capable of being combined with each other completely tightly and simply and a molding method thereof.

2. The Related Art

Currently, a common connector includes an insulating housing, a plurality of terminals molded in the insulating housing, a shielding shell enclosing the insulating housing. When the connector is assembled, the terminals are firstly molded in the insulating housing, and then the insulating housing is inserted into the shielding shell. The insulating housing and the shielding shell are generally assembled together by means of a buckling method, so the insulating housing and the shielding shell can't be assembled completely tightly, and a gap is formed thereamong.

When the above-mentioned connector is used, it's often exposed to a variety of environments including high temperature, low temperature and high humidity environments. Moisture is apt to invade the connector through the gap so as to cause a phenomenon of electric leakage. The quality of the connector is affected. Otherwise, the assembling procedure is complicated, in a process of assembling the connector, the terminals, the inner shell and the outer shell are apt to be deformed.

SUMMARY OF THE INVENTION

An object of the present invention is to provide an electrical connector and a manufacturing method thereof. The electrical connector includes an insulating housing, a plurality of terminals and a shielding shell. The insulating housing has a top wall, two side walls, a bottom wall and a rear wall which are interconnected to form a box shape with an accommodating chamber formed thereamong. The terminals are molded in the insulating housing with contact portions extended into the accommodating chamber. The shielding shell includes an inner shell and an outer shell fixedly attached on the inner shell. The inner shell includes a top plate, two side plates and a bottom plate which are interconnected together to surround a receiving space thereamong. The shielding shell is molded in a periphery of the accommodating chamber with a portion of the outer shell exposed outside the insulating housing.

The method of manufacturing the above-mentioned electrical connector is described hereinafter. Firstly, attach the outer shell on the inner shell fixedly. Secondly, put the shielding shell and a plurality of terminals in a mold, with the terminals suspended in the receiving space. Thirdly, inject molten plastics into the mold to form the insulating housing so as to make the terminals and the shielding shell molded in the insulating housing. Lastly, take out the electrical connector from the mold when the mold is cooled.

As described above, the electrical connector of this invention is formed by means of injecting molten plastics into the mold (not shown) with the shielding shell and the terminals therein. As a result, the shielding shell, the terminals and the insulating housing can be combined completely tightly. A good airtight performance is caused to avoid moisture entering the electrical connector. Accordingly, the manufacturing method of the electrical connector can avoid a process of inserting and withdrawing so as to decrease the possibility of deformation of the terminals, the shielding shell and the insulating housing. And this simple molding method can improve the working efficiency.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
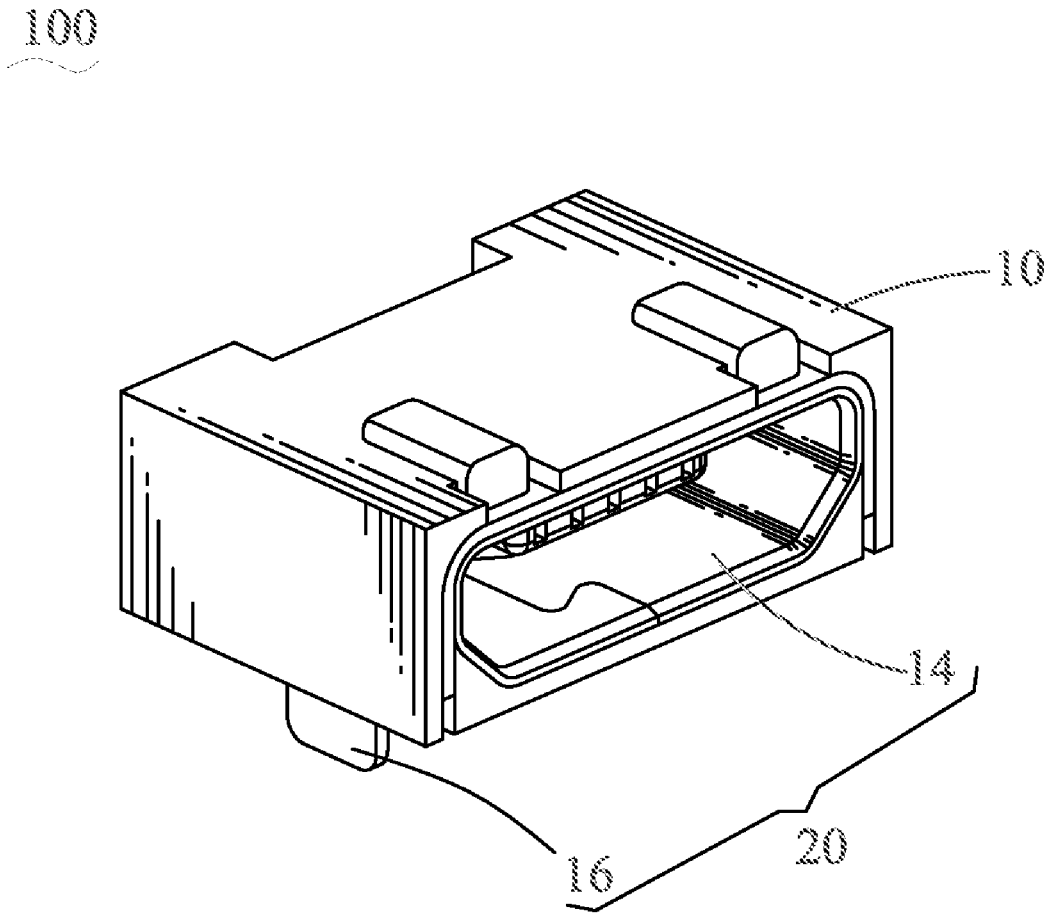
FIG. 1 is an electrical connector according to the present invention.
Figure 2:
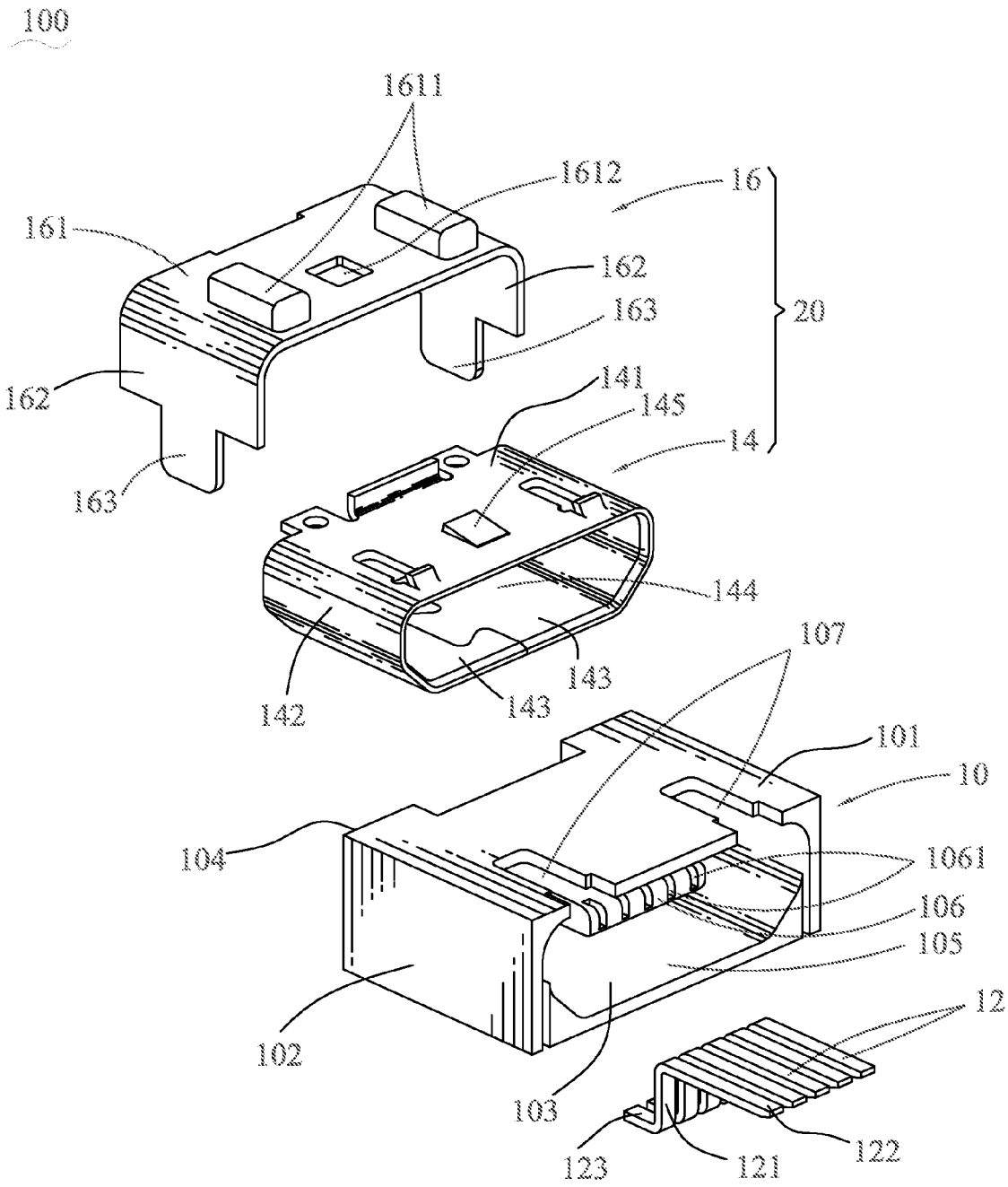
FIG. 2 is an exploded view of the electrical connector of FIG. 1.

Referring to FIGS. 1-2, an electrical connector 100 according to the present invention includes an insulating housing 10, a plurality of terminals 12 molded in the insulating housing 10, and a shielding shell 20.

Figure 3:
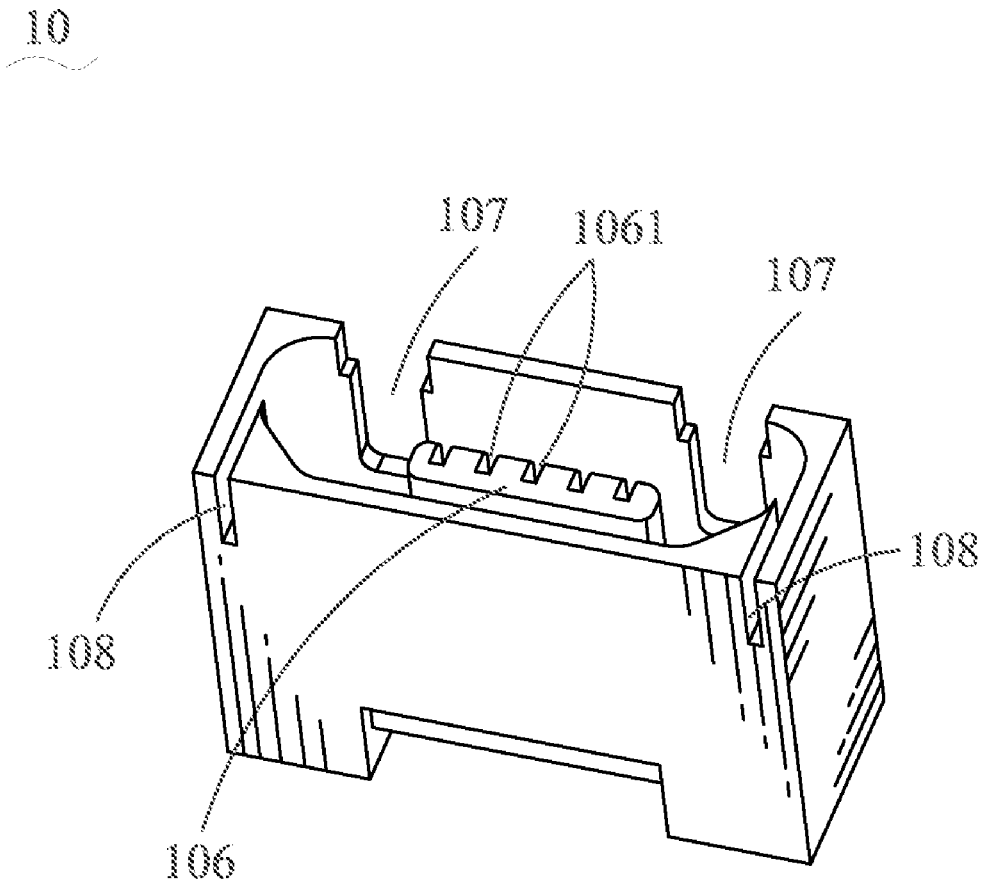
FIG. 3 is a perspective view of an insulating housing of the electrical connector of FIG. 1.

Referring to FIGS. 1-3, the insulating housing 10 is molded in a mold by injecting fluent molten plastics into the mold (not shown). The insulating housing 10 has a top wall 101, two side walls 102, a bottom wall 103 and a rear wall 104 which are interconnected to form a box shape with an accommodating chamber 105 formed thereamong. A middle of a front of the rear wall 104 protrudes forward to form an inserting portion 106 stretching into the accommodating chamber 105. The inserting portion 106 defines a plurality of terminal grooves 1061 passing through a front thereof. Two portions of the top wall 101 are cut off to define two assembling grooves 107 vertically penetrating therethrough and passing through a front of the top wall 101. Each of the two side walls 102 defines a clipping slot 108 penetrating the bottom wall 103 and communicating with one side of the accommodating chamber 105.

Referring to FIGS. 2-3, the terminal 12 is substantially reversed Z-shaped. The terminal 12 has a base portion 121, a contact portion 122 extending perpendicularly from an upper end of the base portion 121, and a soldering portion 123 extending opposite to the contact portion 122 from a lower end of the base portion 121.

Referring to FIGS. 1-2, the shielding shell 20 includes an inner shell 14 and an outer shell 16. The inner shell 14 shows a hollow rectangular box-shape with a top plate 141, two side plates 142 and a bottom plate 143 which are connected together to form a receiving space 144 thereamong. A substantial middle of the top plate 141 protrudes upward to form a buckling block 145. The outer shell 16 has a base plate 161. Two ends of the base plate 161 respectively extend downward to form a clipping plate 162. A middle of a bottom of the clipping plate 162 extends downward to form a soldering portion 163. Two portions of the base plate 161 protrude upward to form two assembling blocks 1611 spaced from each other. A substantial middle of the base plate 161 is cut off to form a rectangular buckling hole 1612. The outer shell 16 is fixedly attached on the inner shell 14 with the base plate 161 attached on the top plate 141 of the inner shell 14 and the buckling block 145 being buckled into the buckling hole 1612 to form the shielding shell 20. In this case, the outer shell 16 and the inner shell 14 are combined with each other by means of laser welding. The shielding shell 20 is molded into the accommodating chamber 105 of the insulating housing 10 with the inserting portion 106 being inserted into the receiving space 144. The assembling blocks 1611 of the outer shell 16 are exposed outside from the assembling grooves 107. The clipping plates 162 of the outer shell 16 are fastened in the clipping slots 108 with the soldering portions 163 extended outside from a bottom of the clipping slots 108 for being soldered with a printed circuit board (not shown).

Referring to FIGS. 1-4, the terminals 12, the insulating housing 10, the inner shell 14 and the outer shell 16 are molded integrally to form the electrical connector 100. Specific steps of manufacturing method of the electrical connector 100 are as following. Firstly, provide the terminals 12, the inner shell 14 and the outer shell 16 which are made of metal, and then make the inner shell 14 and the outer shell 16 combined to form the shielding shell 20 with a receiving space 144 penetrating therethrough from front to rear. Secondly, put the shielding shell 20 in a mold, and make the terminals 12 suspended in the receiving space 144 to form a connector embryo. Thirdly, inject molten plastics into the connector embryo to form the insulating housing 10 so as to make the terminals 12 molded in the terminal grooves 1061 with the contact portions 122 extended into the accommodating chamber 105 and the shielding shell 20 molded in a periphery of the accommodating chamber 105 of the insulating housing 10. Lastly, take out the electrical connector 100, when the mold is cooled.

In this embodiment, the inner shell 14 and the outer shell 16 are welded together by means of the laser welding. Speed of the laser welding method is faster, and depth is deeper. The inner shell 14 and the outer shell 16 are not apt to be deformed during welding.

As described above, the electrical connector 100 of this invention is formed by means of injecting molten plastics into the mold (not shown) with the shielding shell 20 and the terminals 12 therein. As a result, the shielding shell 20, the terminals 12 and the insulating housing 10 can be combined tightly. A good airtight performance is caused to avoid moisture entering the electrical connector 100. Accordingly, the manufacturing method of the electrical connector 100 can avoid a process of inserting and withdrawing so as to decrease the possibility of deforming of the terminals 12, the shielding shell 20 and the insulating housing 10. And this simple molding method can improve the working efficiency.

An embodiment of the present invention has been discussed in detail. However, this embodiment is merely a specific example for clarifying the technical contents of the present invention and the present invention is not to be construed in a restricted sense as limited to this specific example. Thus, the spirit and scope of the present invention are limited only by the appended claims.

What is claimed is:

1. An electrical connector, comprising:

an insulating housing having a top wall, two side walls, a bottom wall and a rear wall which are interconnected to form a box shape with an accommodating chamber formed thereamong;

a plurality of terminals molded in the insulating housing with contact portions extended into the accommodating chamber; and a shielding shell including an inner shell and an outer shell fixedly attached on the inner shell, the inner shell including a top plate, two side plates and a bottom plate which are interconnected together to surround a receiving space thereamong, the shielding shell being molded in a periphery of the accommodating chamber with a portion of the outer shell exposed outside the insulating housing;

wherein a top of the top plate protrudes upward to form a buckling block, and the base plate defines a buckling hole for fastening the buckling block.

2. The electrical connector as claimed in claim 1, wherein two portions of the base plate protrude upward to form two assembling blocks spaced from each other, two portions of the top wall are cut off to define two assembling grooves for receiving the assembling blocks.

3. The electrical connector as claimed in claim 1, wherein the rear wall protrudes frontward to form an inserting portion surrounded by the receiving space, the inserting portion having a plurality of terminal grooves for receiving the terminals.

4. A manufacturing method of the electrical connector according to claim 1, comprising the steps of:

attaching the outer shell on the inner shell fixedly;

putting the shielding shell and a plurality of terminals in a mold, with the terminals suspended in the receiving space;

injecting molten plastics into the mold to form the insulating housing so as to make the terminals and the shielding shell molded in the insulating housing; and taking out the electrical connector from the mold when the mold is cooled.

5. The manufacturing method as claimed in claim 4, wherein the inner shell and the outer shell are welded together by means of laser welding.

6. The manufacturing method as claimed in claim 4, wherein the insulating housing has an inserting portion located in the receiving space for molding with the terminals.

7. The manufacturing method as claimed in claim 4, wherein the outer shell has a base plate attached on the top plate of the inner shell, two ends of the base plate respectively extend downward to form a clipping plate, a portion of the clipping plate extends downward to form a soldering portion, each of the two side walls defines a clipping slot penetrating the bottom wall for fastening the clipping plate and allowing the soldering portion to extend outside therefrom for being soldered with a circuit board.

8. An electrical connector, comprising:

an insulating housing having a top wall, two side walls, a bottom wall and a rear wall which are interconnected to form a box shape with an accommodating chamber formed thereamong;

a plurality of terminals molded in the insulating housing with contact portions extended into the accommodating chamber; and a shielding shell including an inner shell and an outer shell fixedly attached on the inner shell, the inner shell including a top plate, two side plates and a bottom plate which are interconnected together to surround a receiving space thereamong, the shielding shell being molded in a periphery of the accommodating chamber with a portion of the outer shell exposed outside the insulating housing;

wherein the outer shell has a base plate attached on the top plate of the inner shell, two ends of the base plate respectively extend downward to form a clipping plate, a portion of the clipping plate extends downward to form a soldering portion, each of the two side walls defines a clipping slot penetrating the bottom wall for fastening the clipping plate and allowing the soldering portion to extend outside therefrom for being soldered with a circuit board.

* * * * *